US005362065A

United States Patent [19]

Su

[11] Patent Number: 5,362,065

[45] Date of Patent: Nov. 8, 1994

[54] FLYING SAUCER PROJECTING AND CATCHING DEVICE

[76] Inventor: Frank F. S. Su, 5F. No.80, Sec.1, Chung Jen Road, Pei Tou, Taipei, Taiwan, Prov. of China

[21] Appl. No.: 197,782

[22] Filed: Feb. 16, 1994

[51] Int. Cl.[5] ..... A63B 67/06

[52] U.S. Cl. ..... 273/327; 124/16

[58] Field of Search ..... 273/318, 424, 425, 324, 273/327, 412; 124/6, 7, 8, 26, 42, 81, 16

[56] References Cited

U.S. PATENT DOCUMENTS

| | | | |
|---|---|---|---|
| 931,221 | 8/1909 | Rogers | 273/327 |
| 2,085,610 | 6/1937 | Schrickel | 273/327 |
| 2,690,339 | 9/1954 | Hall | 273/327 |
| 4,819,947 | 4/1989 | Mackey | 273/412 |

*Primary Examiner*—William H. Grieb

*Attorney, Agent, or Firm*—Lowe, Price, LeBlanc & Becker

[57] ABSTRACT

A flying saucer projecting and catching device includes a holder consisted of two symmetrical shells, a propeller shaft assembly fastened to the holder and turned by a traction cable, a driving shaft driven by the propeller shaft assembly to send a flying saucer into the air, wherein the holder is made of hornlike shape gradually smaller toward the bottom, having a hand guard for protecting the hand, and a retainer ring through which the traction cable passes; the driving shaft is made gradually smaller toward the top, having a plurality of elongated, raised portions spaced around the periphery thereof near the bottom for holding the flying saucer on the driving shaft.

1 Claim, 8 Drawing Sheets

FLYING SAUCER PROJECTING AND CATCHING DEVICE

BACKGROUND OF THE INVENTION

The present invention relates to a flying saucer projecting and catching device for projecting a flying saucer into the air and then catching it up.

Aerial toys of the flying saucer type have become quite popular. These aerial toys are used in throwing games. Since these aerial toys are thrown into the air by hand, children rapidly tire of the throwing game.

SUMMARY OF THE INVENTION

The present invention provides an implement for projecting an aerial toy of the flying saucer type into the air as well for catching it up before it falls to the ground. The flying saucer projecting and catching device of the present invention allows every individual to play personally. Two or more persons can play together when each one has the respective flying saucer projecting and catching device.

According to the preferred embodiment of the present invention, the flying saucer projecting and catching device comprises a holder consisted of two symmetrical shells, a propeller shaft assembly fastened to the holder and turned by a traction cable, a driving shaft driven by the propeller shaft assembly to send a flying saucer into the air, wherein the propeller shaft assembly includes a spring, which is twisted when the propeller shaft assembly is turned, and which returns to its former shape causing the traction cable taken up by a reel when the traction cable is released from the hand; the holder is made of horn-like shape gradually smaller toward the bottom, having a hand guard for protecting the hand, and a retainer ring through which the traction cable passes; the driving shaft is made gradually smaller toward the top, having a plurality of elongated, raised portions spaced around the periphery thereof near the bottom for holding the flying saucer on the driving shaft.

DETAILED DESCRIPTION OF THE PREFERRED EMBODIMENT

Figure 1:
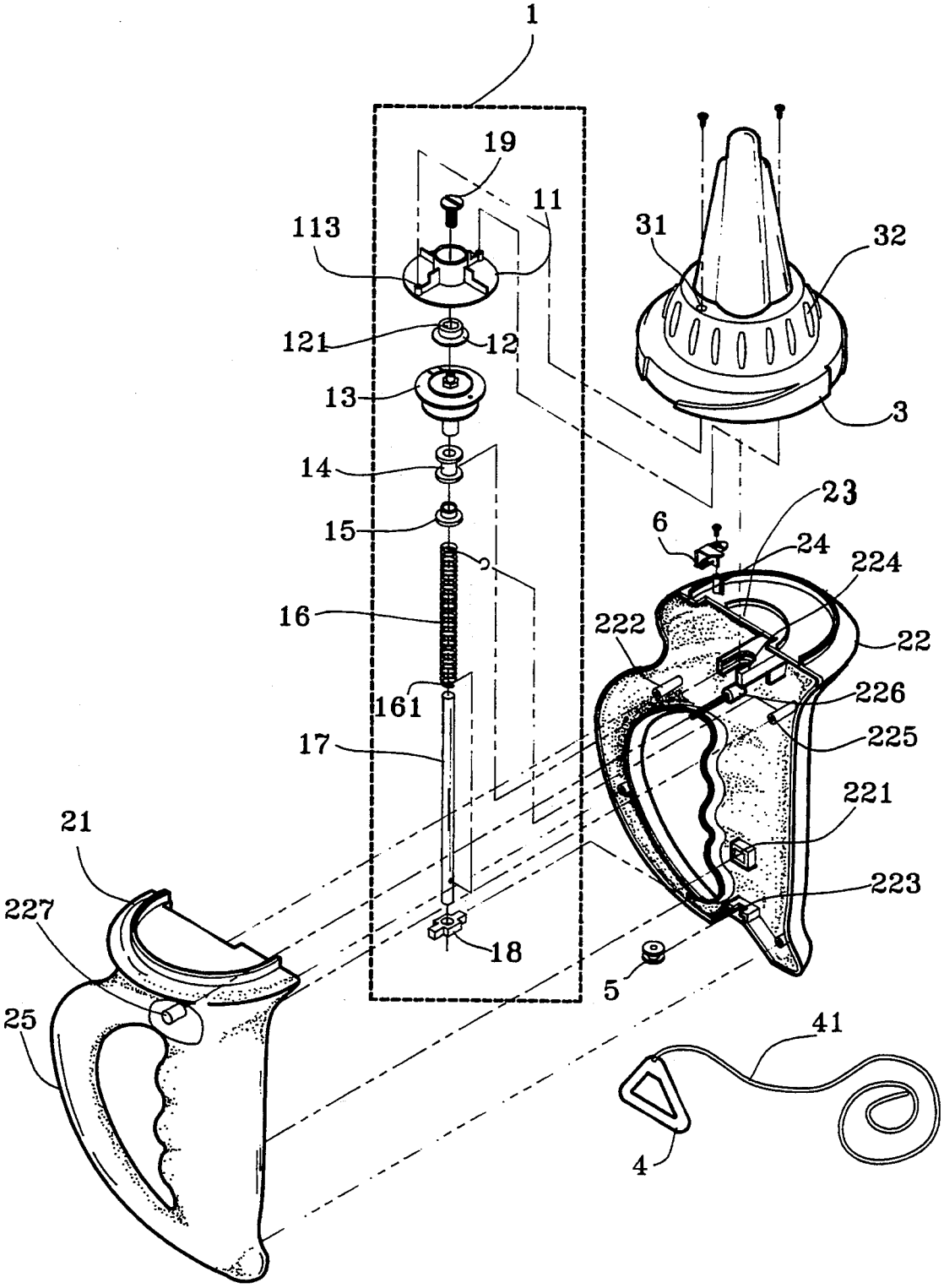
FIG. 1 is an exploded view of a flying saucer projecting and catching device according to the preferred embodiment of the present invention.
Figure 2:
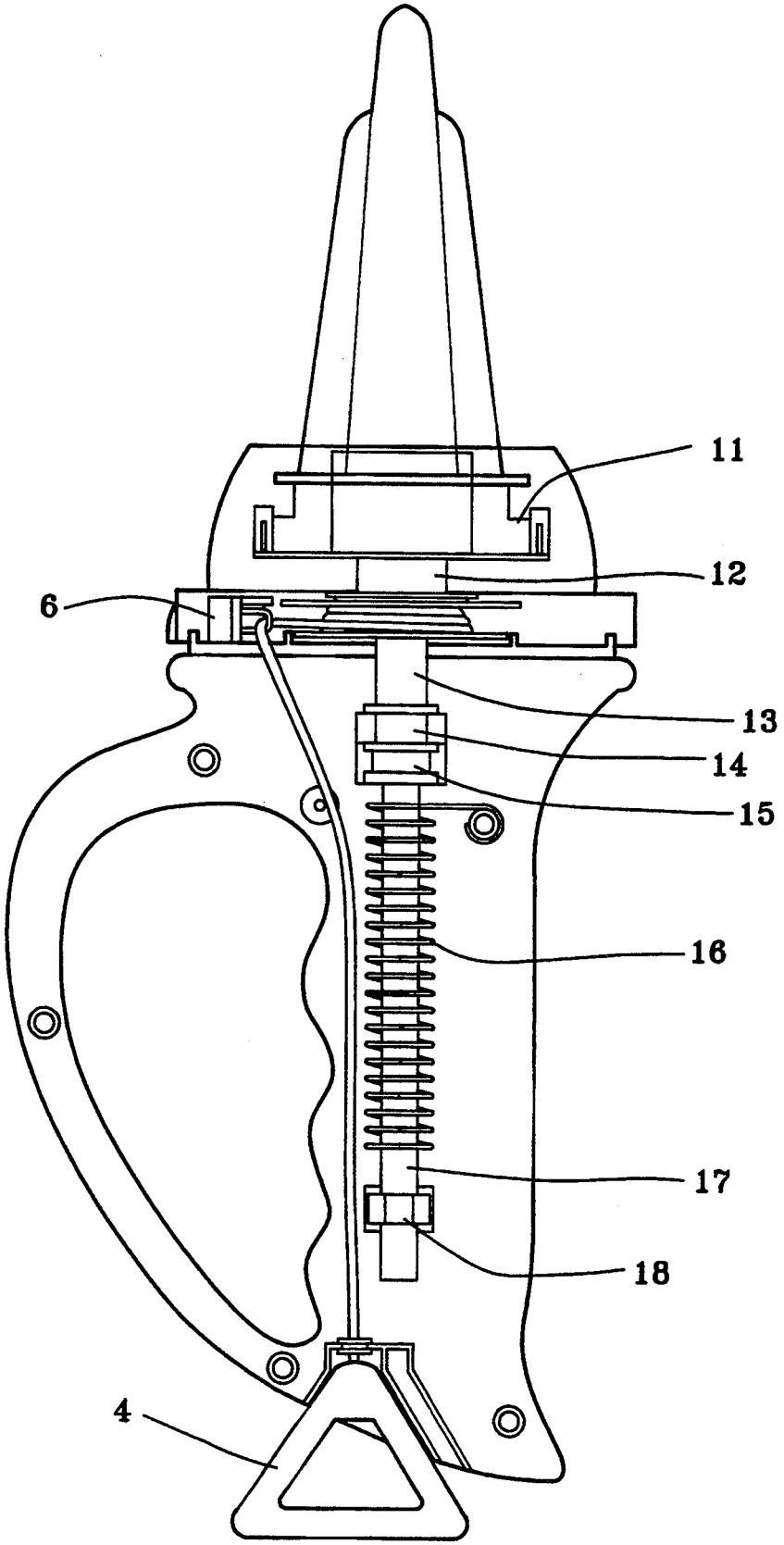
FIG. 2 is a perspective view in plain of the flying saucer projecting and catching device of the preferred embodiment of the present invention.
Figure 3:
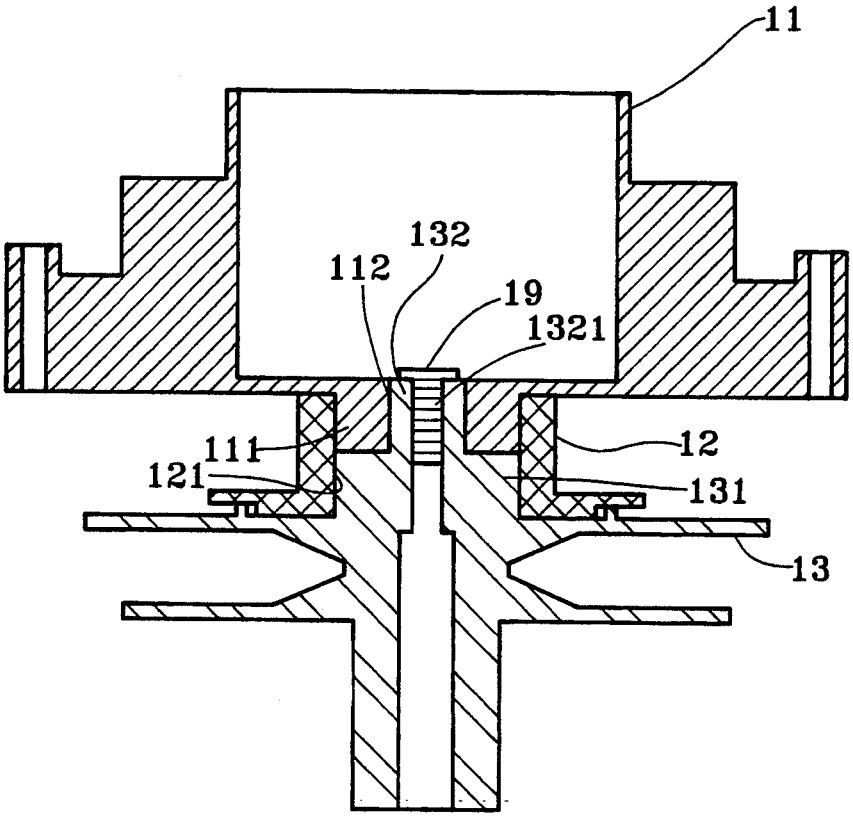
FIG. 3 is a partial view in section of the flying saucer projecting and catching device of the preferred embodiment of the present invention.
Figure 4:
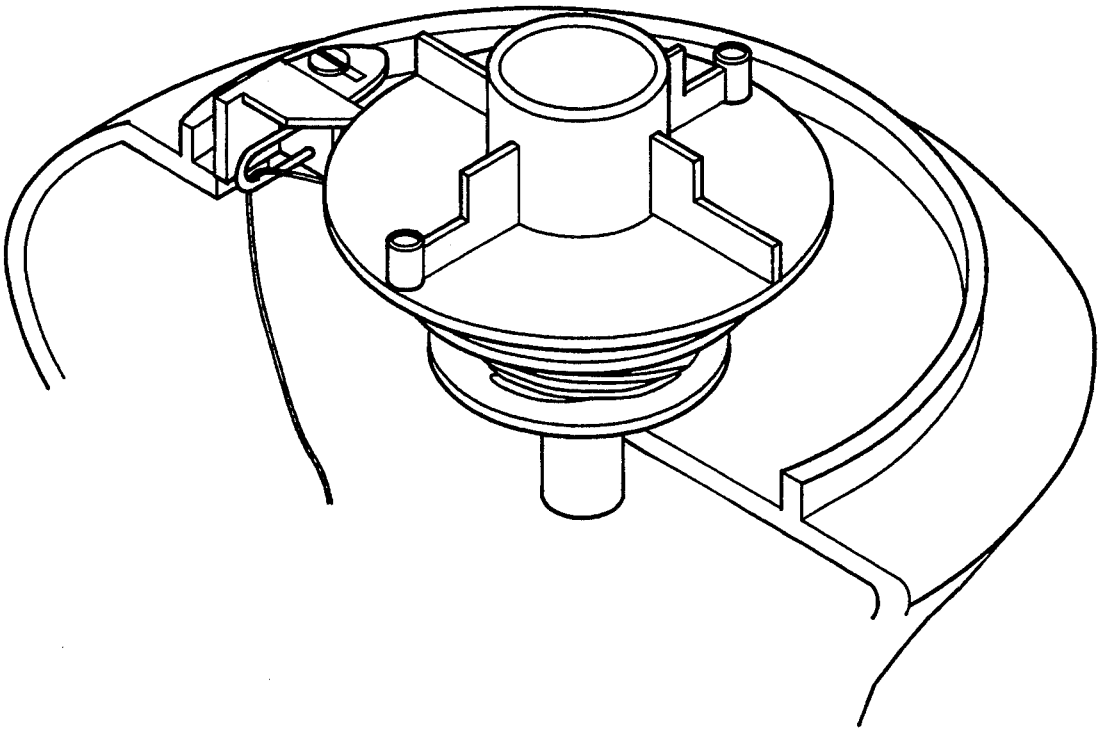
FIG. 4 is a cutaway view in an enlarged scale of the flying saucer projecting and catching device of the preferred embodiment of the present invention.
Figure 5:
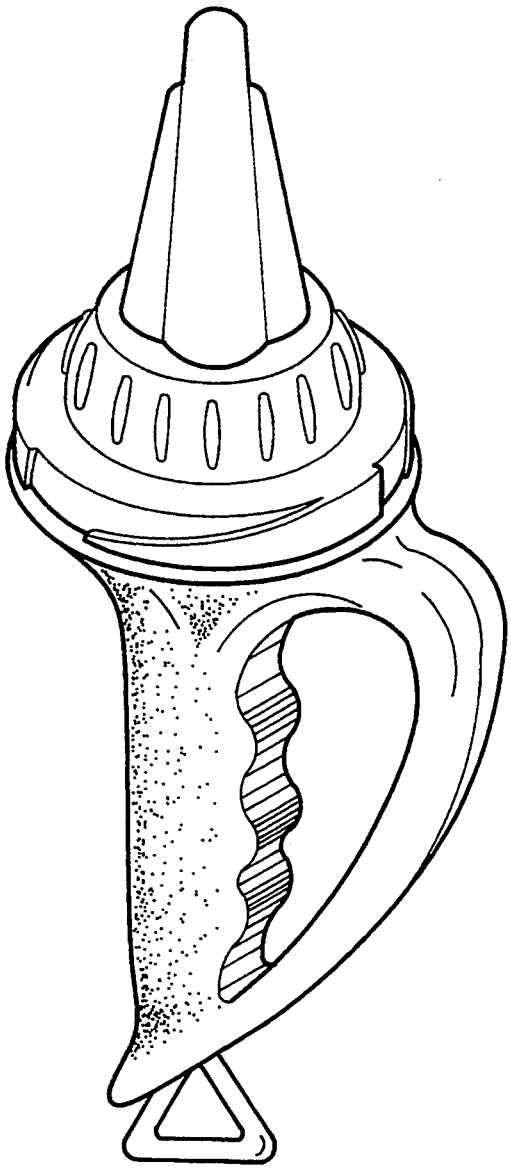
FIG. 5 is an elevational view of the flying saucer projecting and catching device of the preferred embodiment of the present invention.
Figure 6:
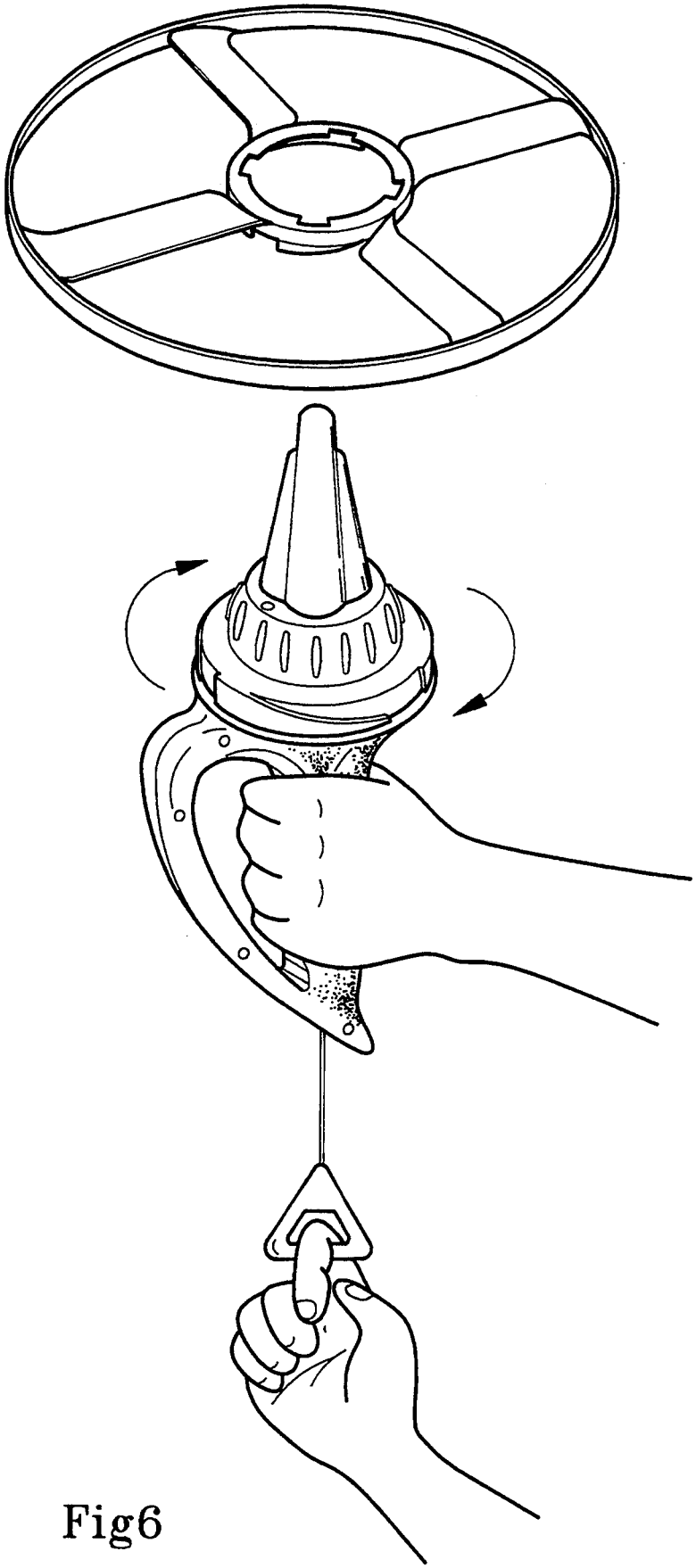
FIG. 6 shows the flying saucer projecting and catching device of the preferred embodiment of the present invention operated.

Referring to FIGS. 1, 2, 3, 4, and 5, a flying saucer projecting and catching device in accordance with the preferred embodiment of the present invention is generally comprised of a propeller shaft assembly 1, a holder 2, and a driving shaft 3.

The propeller shaft assembly 1 is comprised of a propeller disk 11, a connector 12, a reel 13, a locating member 14, a spacer 15, a spring 16, and an elongated shaft 17. The propeller disk 11 has a circular center through hole 112, a hexagonal bottom flange 111 surrounding the circular center through hole 112 at the bottom, and two screw holes 113 at the top. The connector 12 is shaped like a cap having a hexagonal center through hole 121. The reel 13 has a hexagonal block 131 at the top fitted into the hexagonal center through hole 121 on the connector 12 at the bottom, an upright stub rod 132 raised from hexagonal block 131 at the top and fitted into the circular center through hole 112 on the propeller disk 11, and a screw hole 1321 through the longitudinal central axis of the upright stub rod 132. A screw 19 is threaded into the screw hole 1321 on the upright stub rod 132 to fix the propeller disk 11, the connector 12 and the reel 13 together. The spring 16, the spacer 15, and the locating member 14 are respectively mounted around the elongated shaft 17. The spring 16 has a bottom end affixed to the elongated shaft 17 at the bottom. The bottom end of the elongated shaft 17 is mounted with a bearing 18.

The holder 2 is made of horn-like shape gradually smaller toward the bottom, and consisted of two symmetrical shells, namely, the left shell 21 and the right shell 22. The right shell 22 comprises a first bearing seat 221, which receives the bearing 18, a second bearing seat 223, which receives the bearing 5, a spring mounting rod 225, which holds the top end of the spring 16, a cable guide rod 226 fitted into a locating hole 227 on the left shell 21 to guide the traction cable 41, screw holes 224 connected to respective screw holes (not shown) on the left shell 21 by screws, a connector seat 222 to hold the connector 12. The holder 2 comprises reel seat 23 at the top to hold the reel 13, a retainer seat 24, a retainer ring 6 fastened to the retainer seat 24, and a hand guard 25 at one side. There is provided a traction cable 41 having one end fastened to and wound round the reel 13 and an opposite end inserted through a bearing 5 and then the retainer ring 6 and coupled with a handle 4 outside the holder 2.

The driving shaft 3 is made gradually smaller toward the top, having two vertical screw holes 31 respectively fastened to the screw holes 113 on the propeller disk 11 by screws, and a plurality of oblong, raised portions 32 spaced around the periphery thereof near the bottom.

Figure 7:
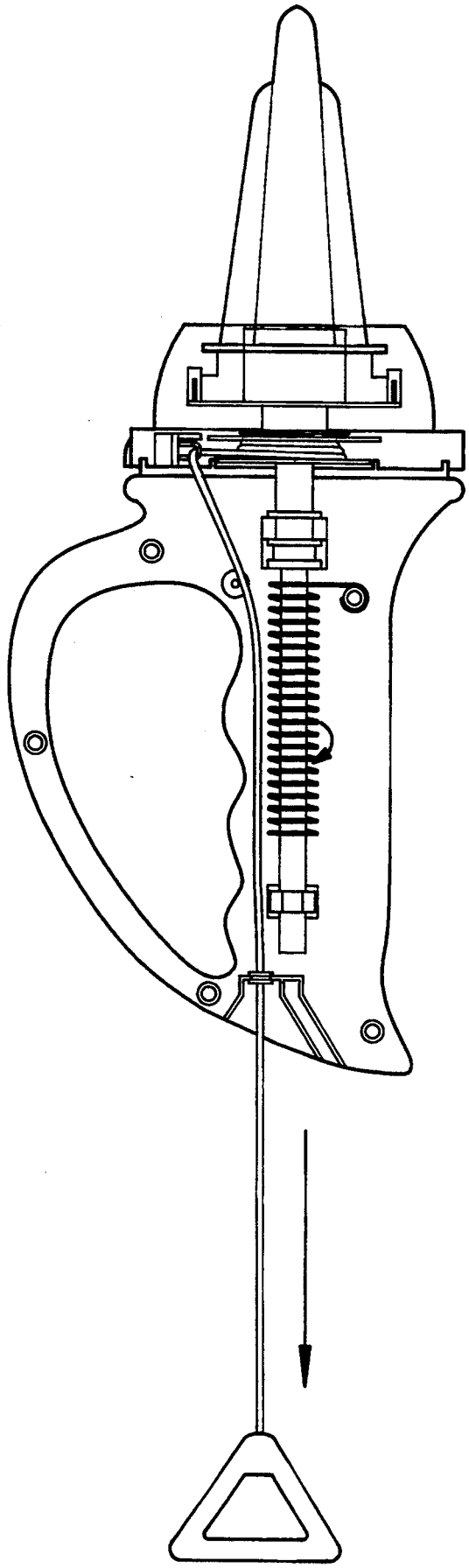
FIG. 7 is similar to FIG. 2 but showing the traction cable pulled.
Figure 8:
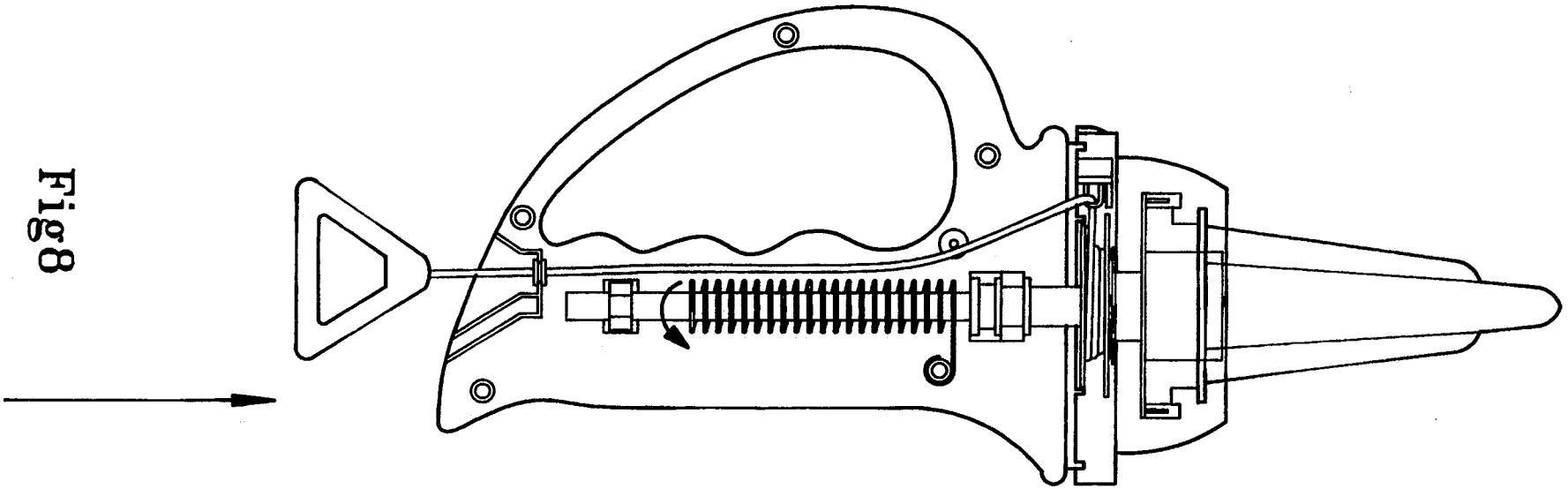
FIG. 8 is similar to FIG. 2 but showing the traction cable taken up.

Referring to FIGS. 7 and 8, when the handle 4 is pulled to draw out the traction cable 41, the propeller shaft assembly 1 is turned round and round causing the flying saucer driven out of the driving shaft 3 into the air, and at the same time the spring 16 is twisted to reserve energy. As the handle 4 is released from the hand after the flying saucer was driven into the air, the spring 16 immediately returns to its former shape causing the reel 13 to take up the traction cable 41. Because the traction cable 41 passes through the retainer ring 6, it can be smoothly taken up by the reel 13 without escaping from the course. When the flying saucer is placed on the driving shaft 3, it is retained in place by the raised portions 32. Furthermore, the arrangement of the hand guard 35 protects the hand from being hurt when falls to the ground.

What is claimed is:

1. A flying saucer projecting and catching device comprising a holder for holding by hand, a propeller shaft assembly fastened to said holder and consisting of a propeller disk, a connector, a reel, a locating member, a spacer, a spring, and an elongated shaft, a driving shaft driven by said propeller disk to turn a flying saucer causing it to fly into the air, and a traction cable having one end fastened to said reel and an opposite end extended out of said holder and coupled with a handle, said traction cable being pulled to turn said propeller disk through said reel causing said driving shaft to send the flying saucer into the air, wherein said holder is made of horn-like shape gradually smaller toward the bottom, having a hand guard for protecting the hand, a retainer ring through which said traction cable passes, said holder being formed of two symmetrical shells fastened together by screws; said driving shaft is made gradually smaller toward the top, having a plurality of elongated, raised portions spaced around the periphery thereof near the bottom for holding the flying saucer on said driving shaft.

* * * * *